US012312701B2

(12) United States Patent
Chang

(10) Patent No.: US 12,312,701 B2
(45) Date of Patent: May 27, 2025

(54) ANODIZING DEVICE

(71) Applicant: HL MANDO CORPORATION, Pyeongtaek-si (KR)

(72) Inventor: Hyunsoo Chang, Asan-si (KR)

(73) Assignee: HL MANDO CORPORATION, Pyeongtaek-si (KR)

( * ) Notice: Subject to any disclaimer, the term of this patent is extended or adjusted under 35 U.S.C. 154(b) by 865 days.

(21) Appl. No.: 17/434,453

(22) PCT Filed: Feb. 27, 2020

(86) PCT No.: PCT/KR2020/002823

§ 371 (c)(1),
(2) Date: Mar. 18, 2022

(87) PCT Pub. No.: WO2020/175934

PCT Pub. Date: Sep. 3, 2020

(65) Prior Publication Data

US 2022/0220625 A1 Jul. 14, 2022

(30) Foreign Application Priority Data

Feb. 27, 2019 (KR) ..... 10-2019-0023346

(51) Int. Cl.
*C25D 11/04* (2006.01)
*C25D 11/00* (2006.01)
(Continued)

(52) U.S. Cl.
CPC ..... *C25D 11/005* (2013.01); *C25D 11/022* (2013.01); *C25D 11/04* (2013.01);
(Continued)

(58) Field of Classification Search
None
See application file for complete search history.

(56) References Cited

U.S. PATENT DOCUMENTS 5,660,704 A 8/1997 Murase
5,980,722 A 11/1999 Kuroda et al.
(Continued)

FOREIGN PATENT DOCUMENTS

JP H07-252686 A 10/1995
JP 3267831 B2 3/2002
KR 10-2016-0084605 A 7/2016

OTHER PUBLICATIONS

English translation JP 2000-192287 (Year: 2000).*
(Continued)

*Primary Examiner* — Stefanie S Wittenberg
(74) *Attorney, Agent, or Firm* — Hauptman Ham, LLP

(57) ABSTRACT

Provided is a anodizing apparatus, including: a base configured to support a target product including a first bore that requires an anodizing surface treatment and a second bore that is connected to the first bore and excluded from the anodizing surface treatment; a working part configured to perform the anodizing surface treatment on the first bore; and a cover part configured to cover an outer surface of the target product, wherein the working part includes at least one electrode bar configured to access and enter the first bore, and a plurality of spray nozzles provided integrally with each of the at least one electrode bar and configured to selectively supply one of a degreasing solution, an electrolyte, and a cleaning solution to the first bore.

14 Claims, 8 Drawing Sheets

(51) Int. Cl.

| | |
|---|---|
| ***C25D 11/02*** | (2006.01) |
| ***C25D 17/00*** | (2006.01) |
| ***C25D 17/12*** | (2006.01) |
| ***C25D 21/12*** | (2006.01) |

(52) U.S. Cl.
CPC ..... *C25D 17/004* (2013.01); *C25D 17/12* (2013.01); *C25D 21/12* (2013.01)

(56) References Cited

U.S. PATENT DOCUMENTS

2010/0104738 A1* 4/2010 Asou ..... C25D 17/06
427/532
2010/0314836 A1* 12/2010 Narita ..... C25D 17/004
277/637

OTHER PUBLICATIONS

English translation WO 2013/178959 (Year: 2013).*
English translation CN 107236979 (Year: 2017).*
International Search Report issued Jun. 24, 2020, corresponding to International Application No. PCT/KR2020/002823.

* cited by examiner

ANODIZING DEVICE

CROSS-REFERENCE TO RELATED APPLICATION

The present application is a national stage filing under 35 U.S.C § 371 of PCT application number PCT/KR2020/002823 filed on Feb. 27, 2020, which is based upon and claims the benefit of priorities to Korean Patent Application No. 10-2019-0023346, filed on Feb. 27, 2019, in the Korean Intellectual Property Office, which is incorporated herein in its entirety by reference.

TECHNICAL FIELD

The disclosure relates to an anodizing apparatus, and more specifically, an anodizing apparatus that may selectively perform an anodizing surface treatment on a portion of a target product such as a sliding part of a hydraulic block.

BACKGROUND ART

In general, anodizing refers to a surface treatment process that paints a surface of a metal product. When a metal being an anode is electrolyzed in an acidic electrolyte, an oxide film with high adhesion is formed on the surface of the metal by oxygen generated from the anode, which is an anodizing process.

Metal products made of aluminum are widely applied in a variety of industries due to advantages in castability, productivity, strength and dimensional accuracy. Despite the advantages and applicability, however, aluminum has low corrosion resistance, and thus aluminum products processed by anodizing surface treatment for increasing corrosion resistance and abrasion resistance and promoting appearance and reliability of the products are being used.

Meanwhile, in a brake system for braking of a vehicle, an aluminum hydraulic block is widely used to form hydraulic pressure in a pressurized medium such as brake oil, etc., and transmit the hydraulic pressure to a wheel cylinder. Inside of the hydraulic block, a plurality of sliding parts in which various pistons reciprocate and a plurality of valve bores in which a variety of valves are installed are provided.

In the sliding parts where pistons such as a master cylinder and a pump reciprocate and form hydraulic pressure or negative pressure in a pressurized medium, the hydraulic block may be worn due to the repeated movement of the piston, and thus metal components of the hydraulic block may be contained in the pressurized medium. Accordingly, the sliding parts are required to be treated by anodizing surface treatment to increase corrosion resistance and abrasion resistance of the hydraulic block.

To prevent the disadvantage described above, in a conventional art, a process of partially removing a portion which is not required to be surface treated through grinding, and the like has been additionally performed after putting the entire hydraulic block in an electrolyte, applying power, and performing anodizing surface treatment on the outer and inner surface of the hydraulic block. Also, in a conventional art, a method of pretreatment of sealing a portion which does not require anodizing surface treatment has been used. However, such processes are complicated and the manufacturing period is long, which results in a decrease in productivity and an increase in manufacturing cost.

DISCLOSURE

Technical Problem

Therefore, it is an aspect of the disclosure to provide an anodizing apparatus that may easily and selectively perform an anodizing surface treatment on a portion which requires the anodizing surface treatment in a target product such as a hydraulic block, and the like.

It is an aspect of the disclosure to provide an anodizing apparatus that may rapidly perform an anodizing surface treatment on a portion which requires the anodizing surface treatment in a target product such as a hydraulic block, and the like.

It is an aspect of the disclosure to provide an anodizing apparatus that may improve quality of an anodizing surface treatment.

It is an aspect of the disclosure to provide an anodizing apparatus that may improve a performance and reliability of a target product such as a hydraulic block, and the like.

It is an aspect of the disclosure to provide an anodizing apparatus that may simplify a process.

It is an aspect of the disclosure to provide an anodizing apparatus that may improve productivity and reduce a manufacturing cost of a target product such as a hydraulic block, and the like.

According to an aspect of the disclosure, there is provided an anodizing apparatus, including: a anodizing apparatus, including: a base configured to support a target product including a first bore that requires an anodizing surface treatment and a second bore that is connected to the first bore and excluded from the anodizing surface treatment; a working part configured to perform the anodizing surface treatment on the first bore; and a cover part configured to cover an outer surface of the target product, wherein the working part includes at least one electrode bar configured to access and enter the first bore, and a plurality of spray nozzles provided integrally with each of the at least one electrode bar and configured to selectively supply one of a degreasing solution, an electrolyte, and a cleaning solution to the first bore.

A lower surface of the target product is covered by the base, and the cover part includes a plurality of first sealing blocks configured to cover a lateral surface of the target product, a second sealing block configured to cover a upper surface of the target product, a plurality of first driving parts configured to approach or separate each of the plurality of first sealing blocks toward/from the target product, and a second driving part configured to approach or separate the second sealing block toward/from the target product.

Each of the plurality of first driving parts includes a main body fixed to the base, a support body configured to support each of the plurality of first sealing blocks, and a first cylinder provided between the main body and the support body and operating extendable and contractible.

The second driving part includes a plurality of columns extending upward from the base, a frame supported by the plurality of columns, and a second cylinder provided between the frame and the second sealing block and operating extendable and contractible.

The anodizing apparatus further includes: a leakage prevention part configured to form an inner space of the cover part or the first bore to be a vacuum partial vacuum.

The leakage prevention part includes at least one suction nozzle formed in each of the at least one electrode bar.

The anodizing apparatus further includes: a pressure sensor configured to sense whether the inner space is sealed.

The at least one electrode bar and the plurality of spray nozzles are inserted through the base.

The at least one electrode bar and the plurality of spray nozzles are inserted through at least one of the plurality of first sealing blocks and supported by the support body.

Each of the plurality of first driving parts further includes a guide part configured to guide reciprocation of the support body with respect the main body.

The guide part includes a guide rod extended parallel to a driving direction of the first cylinder and a guide groove formed through an inside of the main body and on which the guide rod slides.

The at least one electrode bar is extended along an axial direction of the first bore. The plurality of spray nozzles are positioned at regular intervals on a lateral surface of an end of each of the at least one electrode bar.

The working part further includes a sealing member provided on an outer circumferential surface of each of the at least one electrode bar.

The plurality of first sealing blocks and the second sealing block are formed corresponding to an outer shape of the target product.

Advantageous Effects

The anodizing apparatus according to an aspect of the disclosure can easily and selectively perform an anodizing surface treatment on a portion which requires the anodizing surface treatment in a target product such as a hydraulic block, and the like.

The anodizing apparatus according to an aspect of the disclosure can rapidly perform an anodizing surface treatment on a portion which requires the anodizing surface treatment in a target product such as a hydraulic block, and the like.

The anodizing apparatus according to an aspect of the disclosure can improve quality of an anodizing surface treatment.

The anodizing apparatus according to an aspect of the disclosure can improve a performance and reliability of a target product such as a hydraulic block, and the like.

The anodizing apparatus according to an aspect of the disclosure can simplify a process.

The anodizing apparatus according to an aspect of the disclosure can improve productivity and reduce a manufacturing cost of a target product such as a hydraulic block, and the like.

MODE OF THE DISCLOSURE

Hereinafter, embodiments of the present disclosure will be described in detail with reference to the accompanying drawings. The following embodiments are provided to fully convey the spirit of the disclosure to a person having ordinary skill in the art to which the present disclosure belongs. The disclosure is not limited to the embodiments shown herein but may be embodied in other forms. The drawings are not intended to limit the scope of the disclosure in any way, and the size of components may be exaggerated for clarity of illustration.

Figure 1:
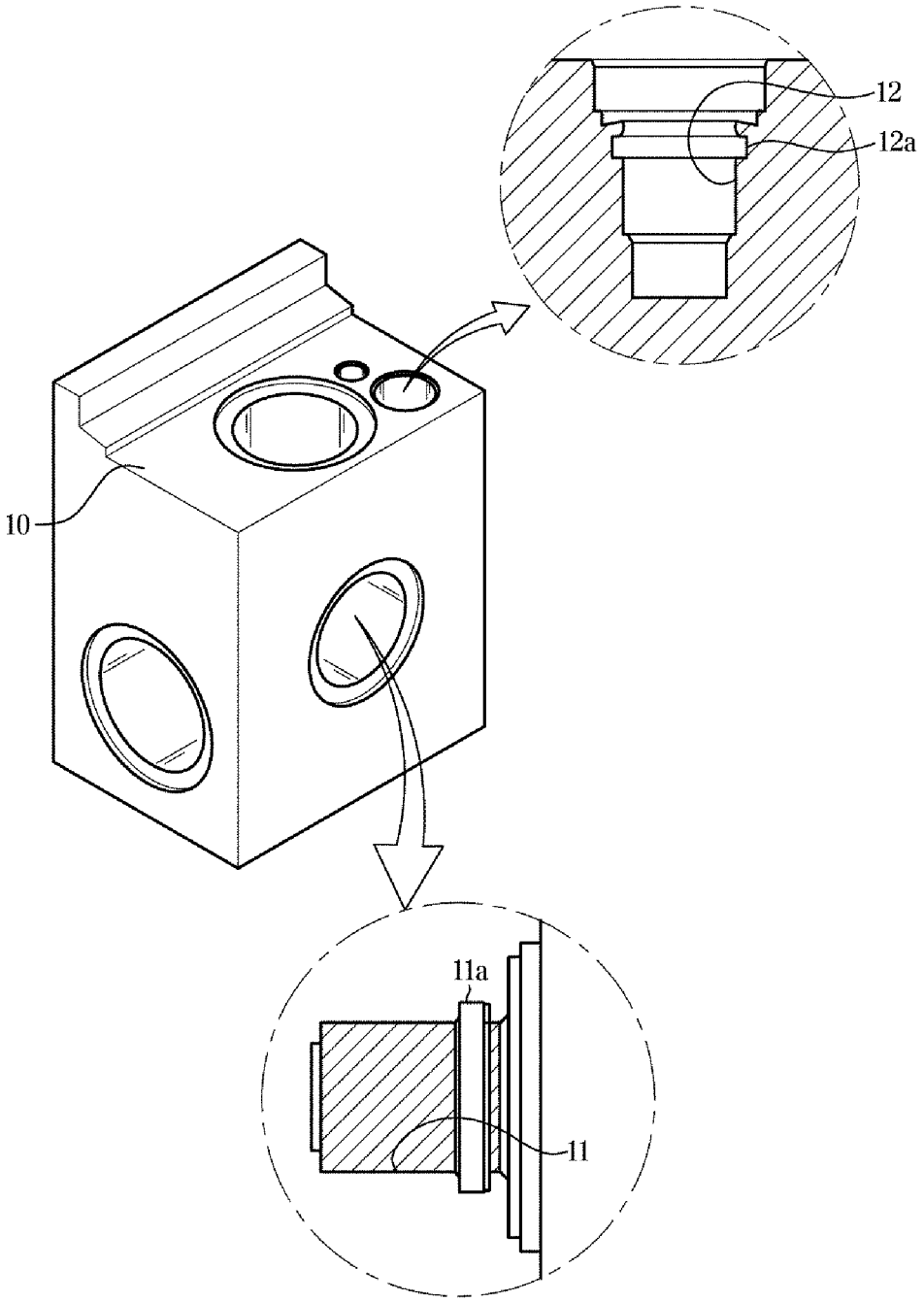
FIG. 1 is a perspective view and a cross-sectional view illustrating a first bore that requires an anodizing surface treatment and a second bore that is excluded from the anodizing surface treatment in a target product of the anodizing surface treatment according to an embodiment of the disclosure.

FIG. 1 is a perspective view and a partial cross-sectional view illustrating a target product 100 of an anodizing surface treatment according to an embodiment of the disclosure.

Referring to FIG. 1, the target product 100 applied to an anodizing apparatus 1000 according to an embodiment of the disclosure may include a portion 11 that requires the anodizing surface treatment, and a portion 12 that is excluded from the anodizing surface treatment. The anodizing apparatus 1000 according to an embodiment of the disclosure may selectively perform an anodizing surface treatment with respect to the portion 11 which requires the anodizing surface treatment.

For example, the target product 10 may be a hydraulic block applied to a brake system for braking a vehicle. The hydraulic block 10 may include a plurality of first bores 11 where various pistons reciprocate and a plurality of second bores 12 where various valves are mounted and fixed.

The first bore 11 may be a sliding part where a piston such as a master cylinder, a pump, and etc., reciprocate and form hydraulic pressure in a pressurized medium such as brake oil, etc. The first bore 11 may be worn due to repeated movement of the piston, and thus metal components of the hydraulic block 10 may be contained in the pressurized medium. Accordingly, the first bore 11 such as the sliding part requires to increase corrosion resistance and abrasion resistance through formation of an oxide film by the anodizing surface treatment.

Figure 3:
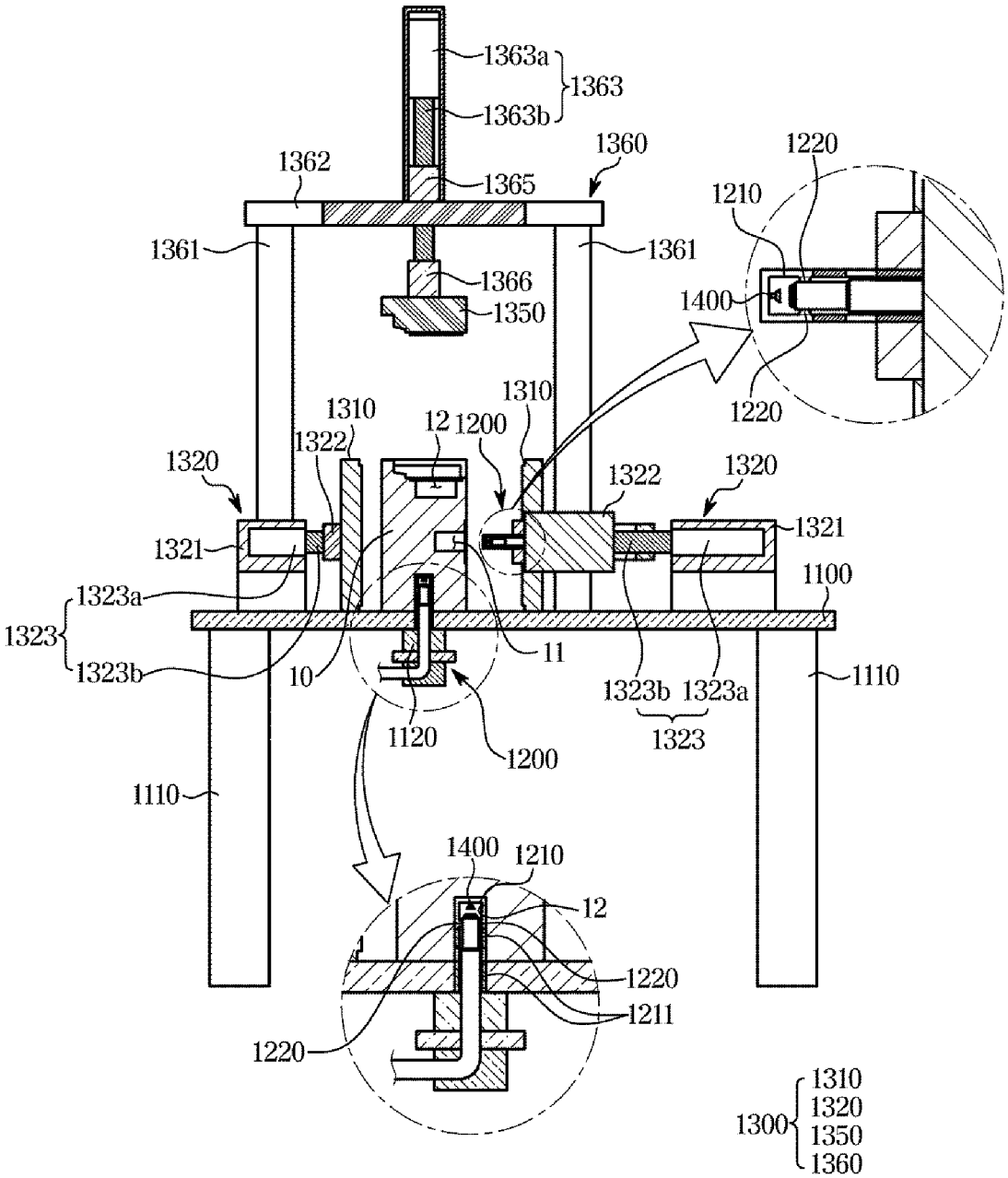
FIG. 3 is a cross-sectional view taken along a line A-A' of FIG. 2.
Figure 4:
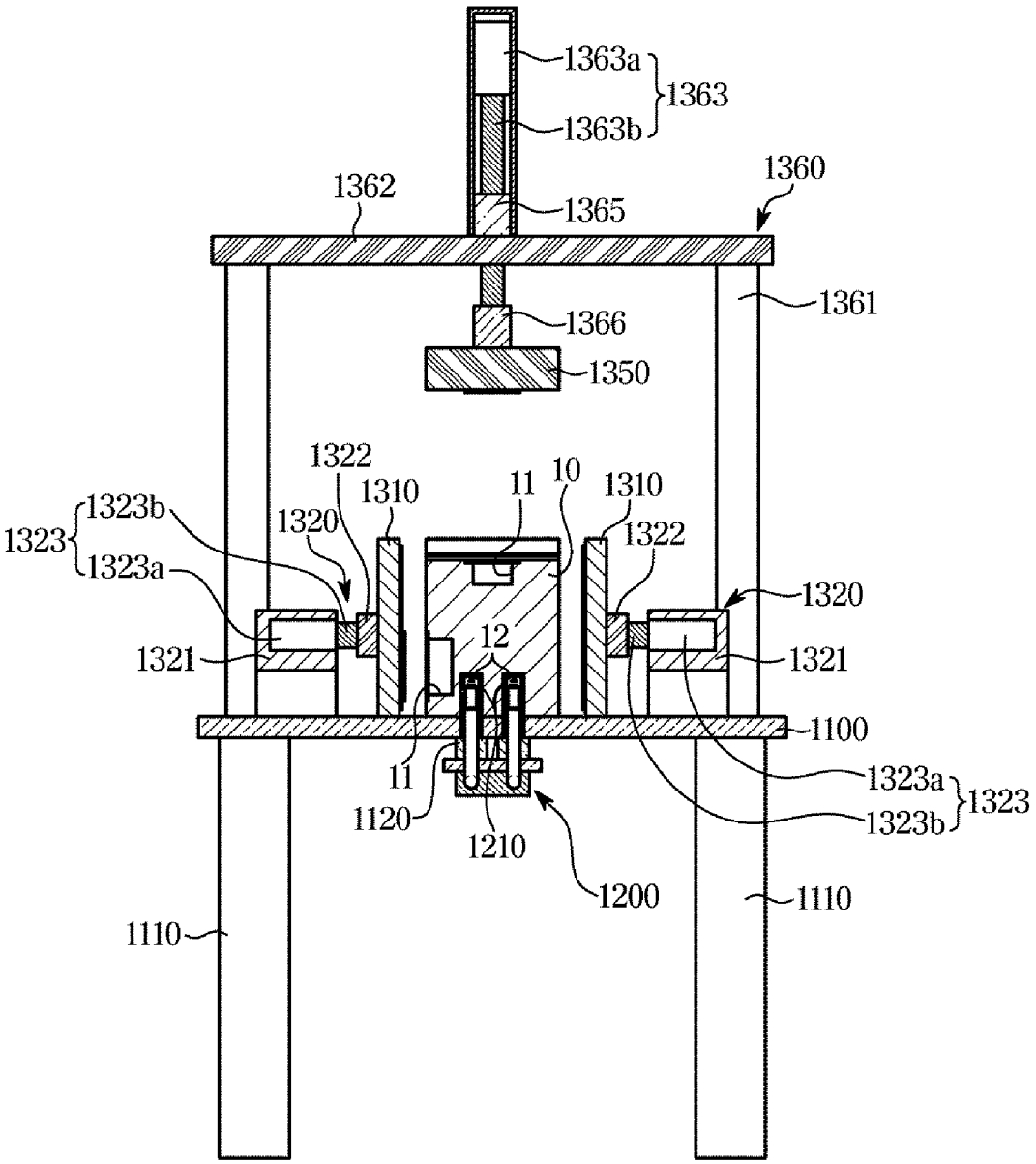
FIG. 4 is a cross-sectional view taken along a line B-B' of FIG. 2.

Meanwhile, a sealing member (not shown) provided in the piston is inserted and installed in a sealing groove 11*a* which is recessed along an inner circumferential surface of the first bore 11. The sealing groove 11*a* is recessed by grinding after performing the anodizing surface treatment on the first bore 11, and thus the anodizing surface treatment is removed. Also, FIG. 1 illustrates only cross-sectional view of the first bore 11 formed on a lateral side of the hydraulic block 10, which is only an example to help understanding of the disclosure. That is, as shown in FIGS. 3 and 4, the plurality of first bores 11 may be formed on a lower surface of the hydraulic block 10.

Each of the second bores 12 is a valve bore where a variety of valves are installed. Because the valves are fixed and operated, corrosion and wear do not occur. Accordingly, the second bores 12 are required to be excluded from the anodizing surface treatment to improve efficiency of manufacturing process and reduce a manufacturing cost of the target product 10.

In a conventional art, to selectively perform an anodizing surface treatment on a target product, a process of partially removing a portion which is not required to be surface treated through grinding has been additionally performed after putting an entire target product in an electrolyte, applying power, and performing anodizing surface treatment on an outer and inner surface of the target product. Also, in a conventional art, an anodizing surface treatment has been performed after masking bores or a portion required to be excluded from the anodizing surface treatment one by one. However, such processes including a pretreatment or a post-treatment such as grinding or sealing are complicated, a manufacturing period is long, and a member for masking the portion to be excluded from the anodizing surface treatment is required to be separately designed and arranged according to a specification of the target product. That is, inefficiency of the manufacturing process is caused.

According to an embodiment of the disclosure, the anodizing apparatus 1000 may selectively perform an anodizing surface treatment only on the first bores 11 of the target product 10 without a separate member or an additional process.

Figure 2:
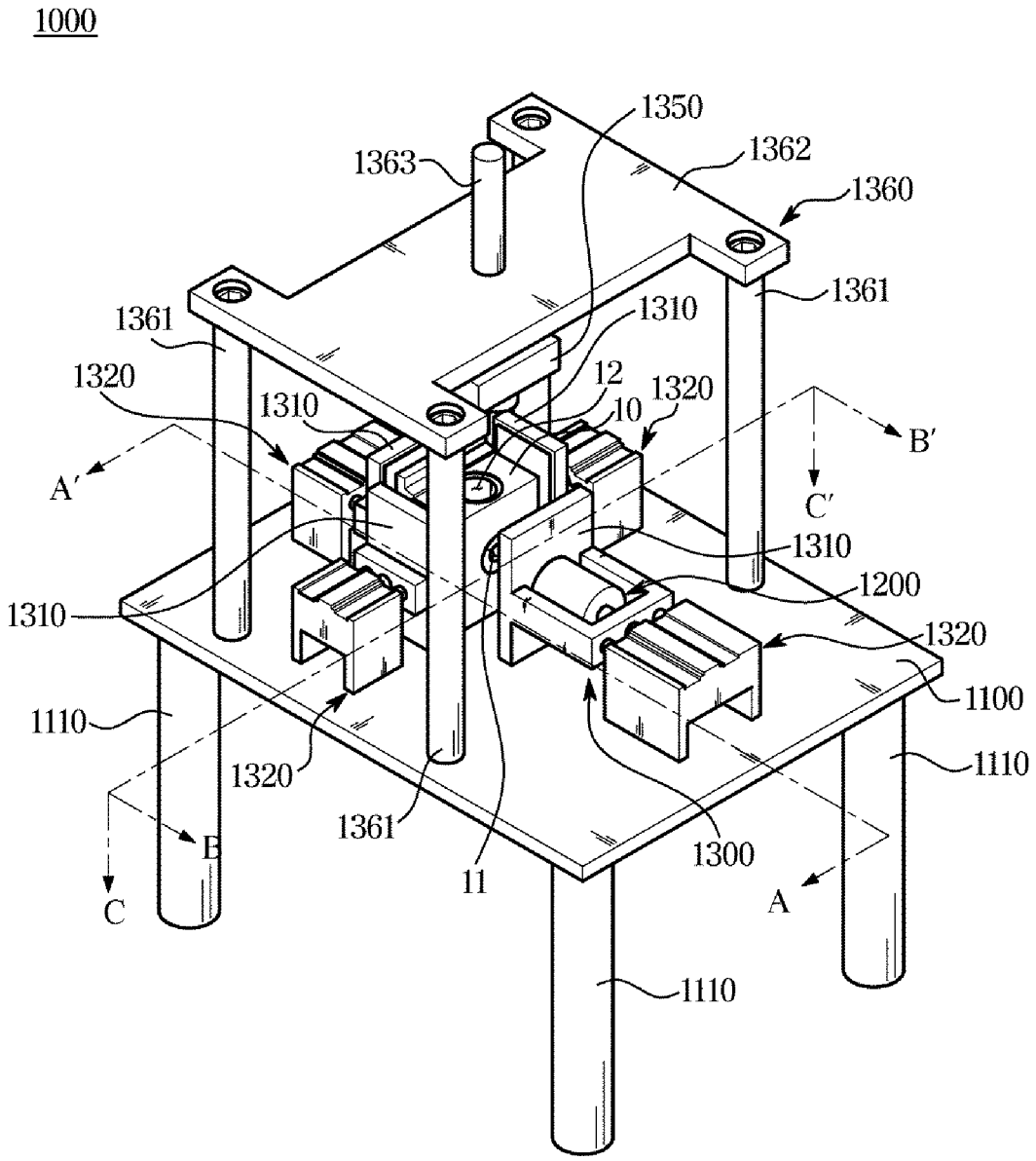
FIG. 2 is a perspective view illustrating an anodizing apparatus according to an embodiment of the disclosure.
Figure 5:
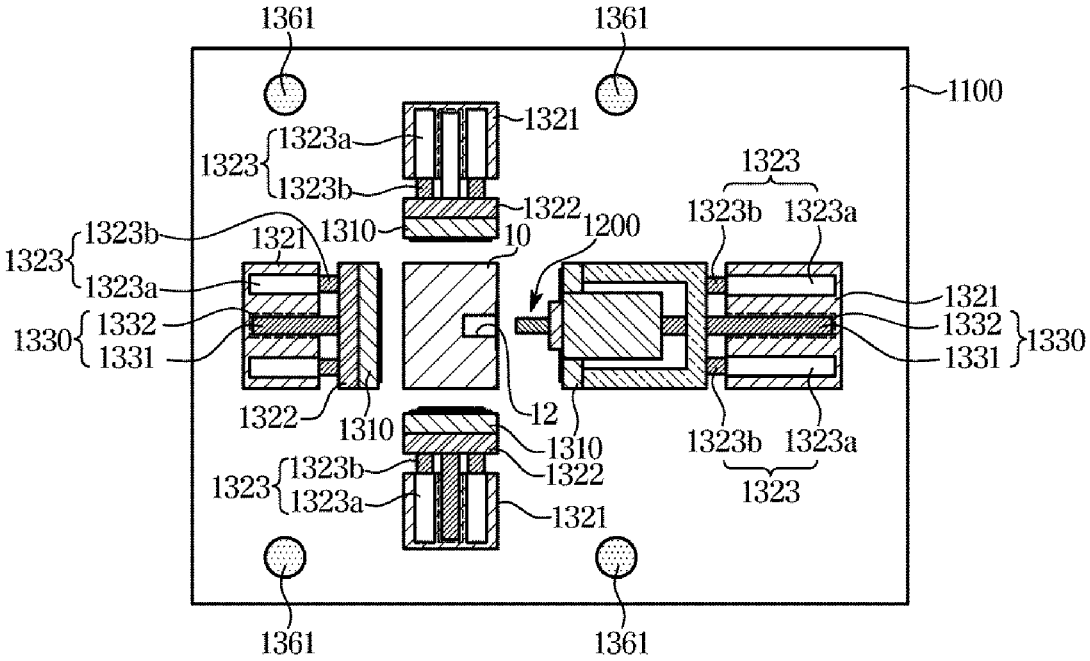
FIG. 5 is a cross-sectional view taken along a line C-C' of FIG. 2.

FIG. 2 is a perspective view illustrating an anodizing apparatus 1000 according to an embodiment of the disclosure. FIGS. 3 through 5 are cross-sectional views taken along a line A-A' of FIG. 2, a line B-B' of FIG. 2, and a line C-C' of FIG. 2, respectively.

Referring to FIGS. 2 through 5, according to an embodiment of the disclosure, the anodizing apparatus 1000 may include a base 1100, a working part 1200, a cover part 1300, a leakage prevention part and a pressure sensor (not shown). The base 1100 supports a target product 10 including a first bore 11 and a second bore 12. The working part 1200 performs the anodizing surface treatment on the first bore 11 and the cover part 1300 closely covers an outer surface of the target product 10. The leakage prevention part forms an inner space 1500 (referring to FIG. 6) partitioned and formed by the cover part 1300 or the first bore 11 to be a vacuum. The pressure sensor senses whether the inner space 1500 partitioned and formed by the cover part 1300 is sealed.

The base 1100 supports a lower surface of the target product 10 and various components to be described later, and also various components may be mounted on the base 1100. The base 1100 has a shape of plate and may be in contact with the lower surface of the target product 10. Also, a plurality of bridges 1110 may be extended in a vertical direction on four edges of the base 1100 to support the base 1100 in a workplace or a supportable structure. The working part 1200 and the cover part 1300 to be described later may be mounted on and supported by a upper surface of the base 1100. In a lower surface of the base 1100, an electrode bar 1210 and a plurality of spray nozzles 1220 of the working part 1200 may be formed to penetrate the base 1100 and be protruded upward, which will be described in detail later.

The working part 1200 is provided to perform the anodizing surface treatment on the first bore 11.

Figure 6:
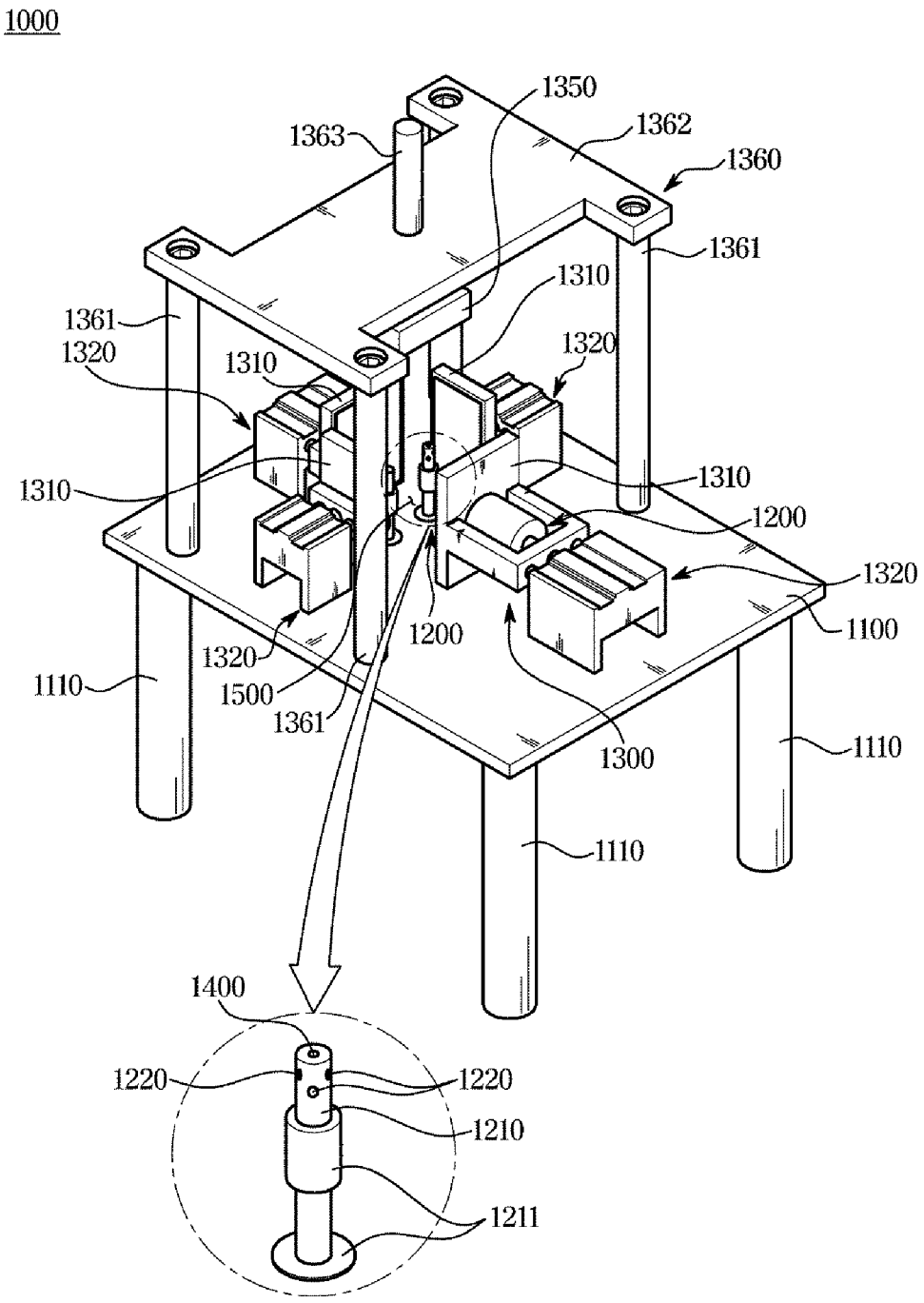
FIG. 6 is a perspective view illustrating an open state of an inner space of a cover part before an anodizing surface treatment of an anodizing apparatus according to an embodiment of the disclosure.

FIG. 6 is a perspective view illustrating a state before the target product 10 is put in the anodizing apparatus 1000 according to an embodiment of the disclosure. Referring to FIGS. 2 through 6, the working part 1200 may include at least one electrode bar 1210 and the plurality of spray nozzles 1220. The at least one electrode bar 1210 is provided to access and enter at least one first bore 11. The plurality of spray nozzles 1220 are provided integrally with each of the at least one electrode bar 1210 and selectively supply one of a degreasing solution, an electrolyte, and a cleaning solution to the first bore 11.

The at least one electrode bar 1210 may have a shape of a bar extending parallel to an axial direction of the first bore 11 to easily access and enter an inside of the first bore 11. Also, the at least one electrode bar 1210 may be provided according to the number of first bores 11 formed in the target product 10. Each of the at least one electrode bar 1210 may be electrically connected to the target product 10 and positive (+) voltage and current may be applied and transmitted to the target product 10 by a power supplier (not shown).

The plurality of spray nozzles 1220 may be provided in an end of the electrode bar 1210 to supply and spray one of the degreasing solution, the electrolyte, and the cleaning solution to the first bore 11. A sealing member 1211 may be provided on an outer circumferential surface of the electrode bar 1210 and be in contact with an inner circumferential surface of the first bore 11 to prevent the degreasing solution, the electrolyte, and the cleaning solution from leaking. When the electrode bar 1210 is formed to penetrate and be inserted into the base 1100 or a first sealing block 1310, the sealing member 1211 may be provided between the electrode bar 1210 and the base 1100. The first sealing block 1310 will be described later.

As an example to help understanding of the disclosure, it is illustrated that one first bore 11 is provided on a lateral surface of the target product 10 and two first bores 11 are provided on a lower surface of the target product 10, and corresponding to the above, one electrode bar 1210 is provided in the first sealing block 1310 and two electrode bars 1210 are provided in the base 1100. That is, the electrode bar 1210 may be provided at different positions according to a position and the number of first bores 11 that require the anodizing surface treatment.

Also, although not illustrated, at least one of a position and an angle of the electrode bar 1210 and the plurality of spray nozzles 1220 may be adjusted and modified automatically by a position adjustment unit (not shown) or manually by an operator. That is, the position and the angle of the electrode bar 1210 and the plurality of spray nozzles 1220 may be adjusted even when the position and angle of the first bore 11 vary according to a type of the target product 10. Accordingly, the anodizing surface treatment may be effectively performed and applicability and compatibility of the anodizing apparatus 1000 may be improved.

The plurality of spray nozzles 1220 may be provided integrally with the electrode bar 1210 by being inserted into the electrode bar 1210. Also, the plurality of spray nozzles 1220 may be positioned at regular intervals on a lateral surface of an end of the electrode bar 1210 to face an inner circumferential surface of the first bore 11. The plurality of spray nozzles 1220 may be connected to each of a degreasing solution supplier (not shown), an electrolyte supplier (not shown), and a cleaning solution supplier (not shown), and selectively supply and spray at least one of the degreasing solution, the electrolyte, or the cleaning solution to the first bore 11.

The anodizing surface treatment includes a degreasing process, a plating process, and a cleaning process. Foreign substances in an area to be surface treated are removed and cleaned in the degreasing process, and an oxide film is formed on a surface of the target product 10 by applying power while supplying an acidic electrolyte in the plating process. Also, the electrolyte remaining in the target product 10 is cleaned in the cleaning process. The spray nozzles 1220 may be selectively supplied with at least one of the degreasing solution used for degreasing process, the electrolyte used for plating process, or the cleaning solution used for cleaning process, and may selectively supply and spray the at least one of the degreasing solution, the electrolyte, or the cleaning solution to the first bore 11.

The target product 10 may be directly or indirectly in contact with a power supplier (not shown) and a positive (+) voltage and current may be applied to the target product 10. The anodizing surface treatment may be performed by forming the oxide film by supplying the electrolyte to the first bore 11 through the spray nozzles 1220 while a negative (−) voltage and current are applied to each of the at least one electrode bar 1210.

The electrode bar 1210 and the spray nozzles 1220 to perform the anodizing surface treatment on the first bore 11 provided on the lateral surface of the target product 10 may be inserted through the first sealing block 1310, and may be supported by a support body 1322 of one of a plurality of first driving parts 1320. The first sealing block 1310 and the plurality of first driving parts 1320 are described in detail later. As the first driving part 1320 operates, the electrode bar 1210 and the spray nozzles 1220 may approach or be spaced apart from the target product 10 or the first bore 11 together with the first sealing block 1310. In addition, the electrode bar 1210 and the spray nozzles 1220 to perform the anodizing surface treatment on the first bore 11 provided on the lower surface of the target product 10 may be mounted and supported on the base 1100 via a support bracket 1120, and be installed by being inserted through the base 1100. The sealing member 1211 may be provided on the outer circumferential surface of the electrode bar 1210 and be in contact with the inner circumferential surface of the first bore 11.

Meanwhile, the electrode bar 1210 may include a suction nozzle 1400 to prevent various fluids used for the anodizing surface treatment, particularly, the electrolyte, from leaking. For the above, the suction nozzle 1400 forms the inner space 1500 of the cover part 1300 or the first bore 11 of the target product 10 to be a vacuum, which will be described in detail later.

The cover part 1300 provided to cover an outer surface of the target product 10 may prevent the degreasing solution, the electrolyte, and the cleaning solution from leaking and simultaneously exclude the second bore 12 of the target product 10 from the anodizing surface treatment.

The cover part 1300 includes the plurality of first sealing blocks 1310, a second sealing block 1350, the plurality of first driving parts 1320 and a second driving part 1360. The plurality of first sealing blocks 1310 cover the lateral surface of the target product 10, and the second sealing block 1350 covers a upper surface of the target product 10. Also, the plurality of first driving parts 1320 approach or separate each of the plurality of first sealing blocks 1310 toward/from the target product 10, and the second driving part 1360 approaches or separates the second sealing block 1350 toward/from the target product 10.

As described above, the lower surface of the target product 10 may be covered and supported by the base 1100, and the lateral surface and the upper surface of the target product 10 may be covered by the first sealing block 1310 and the second sealing block 1350, respectively.

The plurality of first sealing blocks 1310 may be provided to be in contact with and cover the lateral surface of the target product 10. For example, as illustrated, when the target product 10 is a hydraulic block 10 having a hexahedral shape, four groups of the first sealing blocks 1310 may be provided to cover the four lateral surfaces of the hydraulic block 10. A surface of the first sealing block 1310 facing the target product 10 may be formed corresponding to a shape of the lateral surface of the target product 10 in order to be in contact with an outer surface of the target product 10. Because the first sealing block 1310 is in contact with and cover the lateral surface of the target product 10, even when the second bore 12 excluded from the anodizing surface treatment is provided on the lateral surface of the target product 10, the electrolyte may be prevented from transferring to the second bore 12 along the outer surface of the target product 10 without a separate component for sealing the second bore 12. Accordingly, the anodizing surface treatment may be selectively and effectively performed. Further, a leakage prevention part to be described later forms an inner space of the first bore 11 to be a vacuum or a partial vacuum, and thus the electrolyte may be prevented from transferring to the second bore 12 along a flow path formed inside of the target product 10, which will be described in detail later.

The plurality of first driving parts 1320 may be provided to approach or separate each of the first sealing blocks 1310 toward/from the target product 10. Each of the plurality of first driving parts 1320 may include a main body 1321, a support body 1322 and a first cylinder 1323. The main body 1321 is fixed to and supported by the base 1100, the support body 1322 supports the first sealing blocks 1310, and the first cylinder 1323 provided between the main body 1321 and the support body 1322 operates extendable and contractible.

The main body 1321 may be fixedly installed on the base 1100 by fastening bolts, and a hydraulic device 1323*a* of the first cylinder 1323 may be mounted therein. The support body 1322 supporting the first sealing blocks 1310 may be fixedly connected to an operation rod 1323*b* which is protruded and retracted by the hydraulic device 1323*a* of the first cylinder 1323. When the hydraulic device 1323*a* of the first cylinder 1323 operates and the operation rod 1323*b* protrudes, the first cylinder 1323 is extended, and thus the first sealing blocks 1310 may approach the target product 10. When the operation rod 1323*b* is retracted, the first cylinder 1323 may be contracted, and thus the first sealing blocks 1310 may be spaced apart from the target product 10.

Specifically, to close the inner space 1500 of the cover part 1300 where the target product 10 is placed for the anodizing surface treatment on the first bore 11, the first sealing blocks 1310 supported by the support body 1322 may be in contact with and cover the lateral surface of the target product 10 by providing hydraulic pressure to the hydraulic device 1323*a* of the first cylinder 1323 and protruding the operation rod 1323*b*. To open the inner space 1500 of the cover part 1300 or after completing the anodizing surface treatment on the first bore 11, the first sealing blocks 1310 supported by the support body 1322 may be spaced apart from the lateral surface of the target product 10 by discharging hydraulic pressure from the hydraulic device 1323*a* of the first cylinder 1323 and retracting the operation rod 1323*b*. The first cylinder 1323 may operate extendable and contractible by providing or removing hydraulic pressure manually by an operator or automatically by a control system (not shown).

Each of the plurality of first driving parts 1320 may include a guide part 1330 that guides reciprocation of the support body 1322 with respect to the main body 1321. The guide part 1330 may include a guide rod 1331 and a guide groove 1332. The guide rod 1331 is extended in parallel with a longitudinal direction of the operation rod 1323*b* of the first cylinder 1323, and the guide groove 1332 is formed through an inside of the main body 1321 and the guide rod 1331 slides thereon.

Meanwhile, the first driving parts 1320 approach or separate the electrode bar 1210 and the plurality of spray nozzles 1220 toward/from the target product 10 or the first bore 11. Here, the electrode bar 1210 and the plurality of spray nozzles 1220 perform the anodizing surface treatment on the first bore 11 provided on the lateral surface of the target product 10. Specifically, the electrode bar 1210 and the spray nozzles 1220 inserted through the first sealing block 1310 are supported by one of the support body 1322, and thus hydraulic pressure is provided to the hydraulic device 1323*a* of the first cylinder 1323 and the operation rod 1323*b* is protruded. Accordingly, the electrode bar 1210 and the spray nozzles 1220 may approach the target product 10 and the first bore 11 together with the first sealing block 1310. Also, hydraulic pressure is removed from the hydraulic device 1323*a* of the first cylinder 1323, the operation rod 1323*b* is retracted, and thus the electrode bar 1210 and the spray nozzles 1220 may be spaced apart from the target product 10 and the first bore 11 together with the first sealing block 1310.

The second sealing block 1350 may be provided to be in contact with and cover the upper surface of the target product 10. For the above, a surface of the second sealing block 1350 facing the target product 10 may be formed corresponding to a shape of the upper surface of the target product 10 in order to be in contact with the outer surface of the target product 10. Because the second sealing block 1350 is in contact with and cover the upper surface of the target product 10, even when the second bore 12 excluded from the anodizing surface treatment is provided on the upper surface of the target product 10, the electrolyte may be prevented from transferring to the second bore 12 along the outer surface of the target product 10 without a separate component for sealing the second bore 12. Accordingly, the anodizing surface treatment may be selectively and effectively performed. Further, a leakage prevention part to be described later forms an inner of the first bore 11 to be a vacuum or a partial vacuum, and thus the electrolyte may be prevented from transferring to the second bore 12 along a flow path formed inside of the target product 10.

The second driving part 1360 approaches or separates the second sealing block 1350 toward/from the target product 10. The second driving part 1360 includes a plurality of columns 1361, a frame 1362, and a second cylinder 1363. The plurality of columns 1361 extend upward from the base 1100, and the frame 1362 is supported by the plurality of columns 1361. The second cylinder 1363 operates extendable and contractible between the frame 1362 and the second sealing block 1350. Also, the second cylinder 1363 may be fixed to the frame 1362 via a support bracket 1365.

The columns 1361 may be provided as four groups and be fixedly installed on the base 1100 by fastening bolts. The frame 1362 may be fixedly supported on the plurality of columns 1361 by fastening bolts. The second cylinder 1363 may be mounted on the frame 1362, and the second sealing block 1350 may be fixedly connected to an operation rod 1363*b* of the second cylinder 1363. When a hydraulic device 1363*a* of the second cylinder 1363 operates and the operation rod 1363*b* protrudes, the second cylinder 1363 is extended, and thus the second sealing block 1350 may approach the target product 10. When the operation rod 1363*b* is retracted, the second cylinder 1363 is contracted, and thus the second sealing block 1350 may be spaced apart from the target product 10.

Specifically, to close the inner space 1500 of the cover part 1300 where the target product 10 is placed for the anodizing surface treatment on the first bore 11, the second sealing block 1350 supported by the operation rod 1363*b* of the second cylinder 1363 may be in contact with and cover the upper surface of the target product 10 by providing hydraulic pressure to the hydraulic device 1363*a* of the second cylinder 1363 and protruding the operation rod 1363*b*. To open the inner space 1500 of the cover part 1300 or after completing the anodizing surface treatment on the first bore 11, the second sealing block 1350 supported by the operation rod 1363*b* of the second cylinder 1363 may be spaced apart from the upper surface of the target product 10 by discharging hydraulic pressure from the hydraulic device 1363*a* of the second cylinder 1363 and retracting the operation rod 1323*b*. Like the first cylinder 1323, the second cylinder 1363 may operate extendable and contractible by providing or removing hydraulic pressure manually by an operator or automatically by a control system (not shown).

Meanwhile, the second cylinder 1363 may be directly connected to and support the second sealing block 1350, and also be connected to the second sealing block 1350 via a support body 1366. In addition, although not illustrated, a guide part (not shown) may be provided between the support body 1366 and the frame 1362 to guide reciprocation of the second sealing block 1350 by the second driving part 1360.

The leakage prevention part may form the inner space 1500 formed by the first bore 11 or the cover part 1300 to be a vacuum in order to prevent the electrolyte and the cleaning solution from leaking from the first bore 11 or from the inner space 1500 formed by the cover part 1300.

The leakage prevention part may include a vacuum pump (not shown) and at least one suction nozzle 1400 connected to the vacuum pump. The at least one suction nozzle 1400 may be provided at an end of the electrode bar 1210. Also, the at least one suction nozzle 1400 may suck air remaining in the inner space 1500 of the cover part 1300 or the first bore 11, and thus the inner space 1500 partitioned and sealed by the first bore 11 or the cover part 1300 may be in a vacuum state.

As described above, when the anodizing surface treatment is performed on the first bore 11, the plurality of spray nozzles 1220 of the electrode bar 1210 supply and spray one of the degreasing solution, the electrolyte, and the cleaning solution. In this instance, when the electrolyte leaks to an outside of the inner space 1500 partitioned and sealed by the cover part 1300, the acidic electrolyte is exposed outside, which causes a safety accident. In particular, when the electrolyte leaks outside of the first bore 11, the electrolyte leaks into the second bore 12 excluded from the anodizing surface treatment, which leads to a deterioration of quality of the anodizing surface treatment. To prevent the degreasing solution, the electrolyte, and the cleaning solution from leaking to the outside of the inner space 1500 of the cover part 1300, the suction nozzle 1400 of the leakage prevention part sucks air remaining in the inner space 1500 of the cover part 1300 and make a pressure of the inner space 1500 to be lower than an external pressure. Accordingly, surrounding facilities may be protected and safety accidents may be prevented. Further, the suction nozzle 1400 of the leakage prevention part makes a pressure of the first bore 11 to be lower than a pressure of the second bore 12, and thus the electrolyte may be prevented from leaking to the second bore 12 and a quality of the anodizing surface treatment may be improved.

A pressure sensor (not shown) may be provided to sense whether the inner space 1500 of the cover part 1300 where the target product 10 is placed is sealed.

The pressure sensor may be provided on one of the at least one electrode bar 1210, and sense whether the inner space 1500 is sealed by measuring an internal pressure of the inner space 1500 before and after an operation of the suction nozzle 1400 of the leakage prevention part.

Specifically, in a state where the first sealing blocks 1310 and the second sealing block 1350 are in contact with the outer surface of the target product 10 by extending the first driving parts 1320 and the second driving part 1360 of the cover part 1300 for the anodizing surface treatment, the pressure sensor measures a pressure value of the inner space 1500, and then measures a pressure value of the inner space 1500 in a state where the suction nozzle 1400 of the leakage prevention part is operating. By comparing the two pressure values, when the pressure value measured when the suction nozzle 1400 is operating decreases by a preset or predicted pressure level compared to the other pressure value, a control part may determine that a vacuum or a partial vacuum state is stably formed by the suction nozzle 1400 and the inner space 1500 is sealed. Accordingly, the anodizing surface treatment may be continuously performed.

By contrast, when the pressure value measured when the suction nozzle 1400 is operating does not decrease by the preset or predicted pressure level compared to the other pressure value, the control part may determine that the inner space 1500 is not normally sealed by the cover part 1300, and notify an operator of a risk of electrolyte leakage using a display (not shown) or a warning light and stop the anodizing surface treatment simultaneously.

Hereinafter, operations of the anodizing apparatus 1000 according to an embodiment of the disclosure is described.

Figure 7:
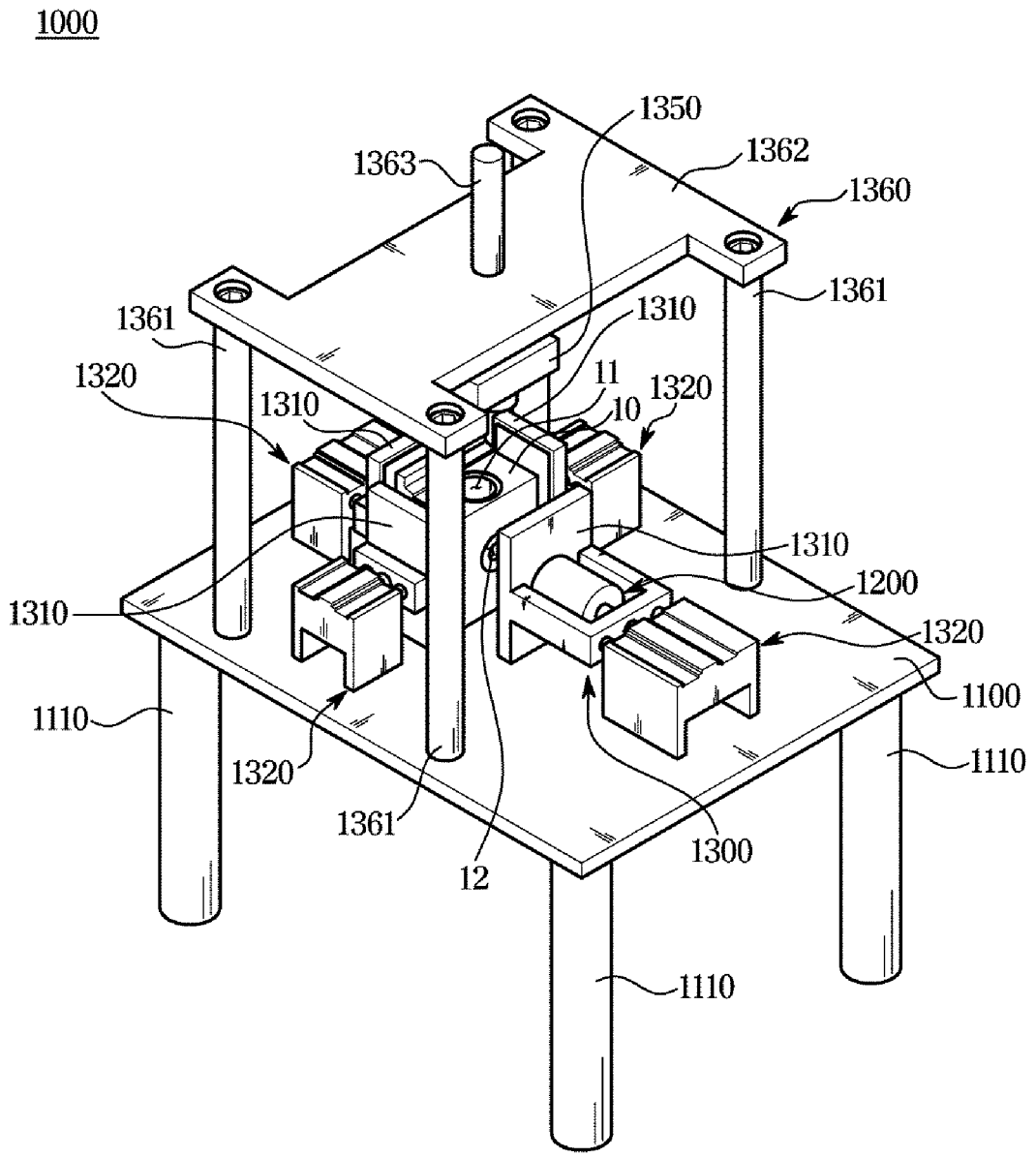
FIG. 7 is a perspective view illustrating a state where a target product is placed in an inner space of a cover part for an anodizing surface treatment of an anodizing apparatus according to an embodiment of the disclosure.
Figure 8:
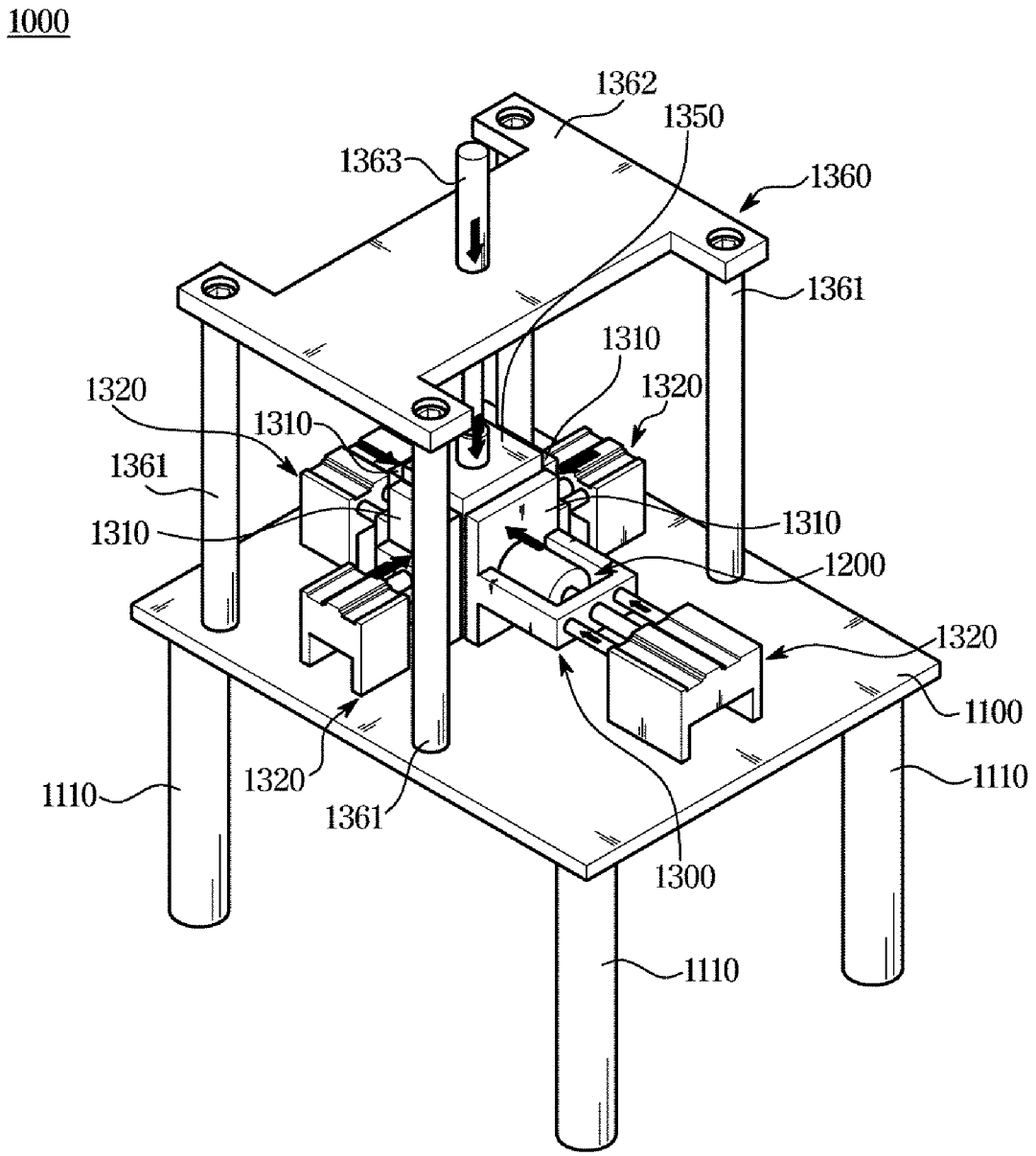
FIG. 8 is a perspective view illustrating a state where an inner space of a cover part is sealed during an anodizing surface treatment of an anodizing apparatus according to an embodiment of the disclosure.

FIGS. 6 through 8 are perspective views illustrating operation states of the anodizing apparatus 1000 according to an embodiment of the disclosure. FIG. 6 illustrates an open state of the inner space 1500 of the cover part 1300 before an anodizing surface treatment, and FIG. 7 illustrates a state where the target product 10 is placed in the inner space 1500 of the cover part 1300 for the anodizing surface treatment. FIG. 8 illustrates a state where the inner space 1500 of the cover part 1300 is sealed during the anodizing surface treatment.

Referring to FIG. 6, to open the inner space 1500 of the cover part 1300 for the anodizing surface treatment, the first sealing blocks 1310 and the second sealing block 1350 are spaced apart from the inner space 1500. Specifically, the first sealing blocks 1310 supported by the support body 1322 and the support body 1322 are moved outwardly by discharging hydraulic pressure from the hydraulic device 1323*a* of the plurality of first cylinders 1323 manually by an operator or automatically by the control part (not shown) and by contracting the operation rod 1323*b*. Simultaneously, the second sealing block 1350 is moved upward by discharging hydraulic pressure from the hydraulic device 1363*a* of the second cylinder 1363 and by contracting the operation rod 1363*b*. Accordingly, the inner space 1500 may be open to place the target product 10.

Afterwards, the target product 10 where the anodizing surface treatment is to be performed is placed on an upper surface of the base 1100 and put into the inner space 1500 of the cover part 1300 simultaneously. In this instance, when the first bore 11 that requires the anodizing surface treatment exists on a lower surface of the target product 10, the first bore 11 is arranged to be close to the electrode bar 1210 and the plurality of spray nozzles 1220 protruded from the base 1100. (referring to FIG. 7)

After the target product 10 is placed on the base 1100 and put into the inner space 1500 of the cover part 1300, the inner space 1500 of the cover part 1300 is sealed for the anodizing surface treatment. Specifically, the first sealing blocks 1310 supported by the support body 1322 and the support body 1322 may be moved to and be in contact with the lateral surface of the target product 10 by providing hydraulic pressure to the hydraulic device 1323*a* of each of the plurality of first cylinders 1323 manually by an operator or automatically by the control part (not shown) and by extending the operation rod 1323*b*. Here, the support body 1322 is fixedly connected to the operation rod 1323*b*. At the same time, the second sealing block 1350 may be moved to and in contact with the upper surface of the target product 10 by providing hydraulic pressure to the hydraulic device 1363*a* of the second cylinder 1363 and extending the operation rod 1363*b*, and thus the inner space 1500 of the cover part 1300 may be sealed. Afterwards, the working part 1200 sequentially supplies and sprays the degreasing solution, the electrolyte, and the cleaning solution to the first bore 11, and thus the anodizing surface treatment may be performed on the first bore 11.

As described above, a variety of fluids sprayed by the spray nozzles 1220 of the electrode bar 1210 for the anodizing surface treatment, such as the degreasing solution, the electrolyte, and the cleaning solution, can be prevented from leaking by sealing, by the cover part 1300, the inner space 1500 where the target product 10 is placed. In particular, the acidic electrolyte can be prevented from leaking, and thereby can prevent a safety accident and protect surrounding facilities. Further, the base 1100 and the cover part 1300 can be in contact with and cover the outer surface of the target product 10 regardless of a shape of the target product 10 and a position of the second bore 12, and thus a separate member for sealing the second bore 12 is not required to be designed and arranged. Accordingly, a process for selective anodizing surface treatment on the first bore 11 can be simplified and productivity can be improved. In addition, the suction nozzle 1400 can form the first bore 11 or the inner space 1500 of the cover part 1300 to be a vacuum or partial vacuum, and thereby can effectively prevent various fluids from leaking and prevent the electrolyte from leaking into the second bore 12 excluded from the anodizing surface treatment. Accordingly, a quality and reliability of the anodizing surface treatment can be improved.

Although embodiments of the disclosure have been described with reference to the accompanying drawings, a person having ordinary skilled in the art will appreciate that other specific modifications may be easily made without departing from the technical spirit or essential features of the disclosure. Therefore, the foregoing embodiments should be regarded as illustrative rather than limiting in all aspects.

The invention claimed is:

1. An anodizing apparatus, comprising:

a base configured to support a target product comprising a first bore that requires an anodizing surface treatment and a second bore that is excluded from the anodizing surface treatment;

a working part configured to perform the anodizing surface treatment on the first bore; and a cover part configured to cover an outer surface of the target product, wherein the working part comprises at least one electrode bar configured to access and enter the first bore, and a plurality of spray nozzles provided integrally with each of the at least one electrode bar and configured to selectively supply one of a degreasing solution, an electrolyte, and a cleaning solution to the first bore, a lower surface of the target product is covered by the base, and the cover part comprises a plurality of first sealing blocks configured to cover a lateral surface of the target product, a plurality of first driving parts configured to approach or separate each of the plurality of first sealing blocks toward and/or away from the target product, a second sealing block configured to cover an upper surface of the target product, and a second driving part configured to approach or separate the second sealing block toward and/or away from the target product.

2. The anodizing apparatus of claim 1, wherein each of the plurality of first driving parts comprises a main body fixed to the base, a support body configured to support each of the plurality of first sealing blocks, and a first cylinder provided between the main body and the support body and operating extendable and contractible.

3. The anodizing apparatus of claim 2, wherein the second driving part comprises a plurality of columns extending upward from the base, a frame supported by the plurality of columns, and a second cylinder provided between the frame and the second sealing block and operating extendable and contractible.

4. The anodizing apparatus of claim 1, further comprising:

a leakage prevention part configured to form an inner space of the cover part or the first bore to be a vacuum or a partial vacuum.

5. The anodizing apparatus of claim 4, wherein the leakage prevention part comprises at least one suction nozzle formed in each of the at least one electrode bar.

6. The anodizing apparatus of claim 4, further comprising:

a pressure sensor configured to sense whether the inner space is sealed.

7. The anodizing apparatus of claim 1, wherein the at least one electrode bar and the plurality of spray nozzles are inserted through the base.

8. The anodizing apparatus of claim 2, wherein the at least one electrode bar and the plurality of spray nozzles are inserted through at least one of the plurality of first sealing blocks and supported by the support body.

9. The anodizing apparatus of claim 8, wherein each of the plurality of first driving parts further comprises a guide part configured to guide reciprocation of the support body with respect to the main body.

10. The anodizing apparatus of claim 9, wherein the guide part comprises a guide rod extended parallel to a driving direction of the first cylinder and a guide groove formed through an inside of the main body and on which the guide rod slides.

11. The anodizing apparatus of claim 7, wherein the at least one electrode bar is extended along an axial direction of the first bore.

12. The anodizing apparatus of claim 1, wherein the plurality of spray nozzles are positioned at regular intervals on a lateral surface of an end of each of the at least one electrode bar.

13. The anodizing apparatus of claim 12, wherein the working part further comprises a sealing member provided on an outer circumferential surface of each of the at least one electrode bar.

14. The anodizing apparatus of claim 1, wherein the plurality of first sealing blocks and the second sealing block are formed corresponding to an outer shape of the target product.

* * * * *